US011100836B2

(12) United States Patent
Dong

(10) Patent No.: US 11,100,836 B2
(45) Date of Patent: Aug. 24, 2021

(54) DRIVING METHOD FOR DISPLAY PANEL, DRIVING DEVICE THEREOF AND DISPLAY DEVICE

(71) Applicant: HKC Corporation Limited, Shenzhen (CN)

(72) Inventor: Sheng Dong, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/982,542

(22) PCT Filed: Nov. 15, 2018

(86) PCT No.: PCT/CN2018/115608
§ 371 (c)(1),
(2) Date: Sep. 19, 2020

(87) PCT Pub. No.: WO2020/087575
PCT Pub. Date: May 7, 2020

(65) Prior Publication Data

US 2021/0005125 A1 Jan. 7, 2021

(30) Foreign Application Priority Data

Oct. 29, 2018 (CN) ..... 201811267637.1

(51) Int. Cl.
*G09G 3/20* (2006.01)

(52) U.S. Cl.
CPC ..... *G09G 3/20* (2013.01); *G09G 2300/0871* (2013.01); *G09G 2310/027* (2013.01); *G09G 2310/0291* (2013.01)

(58) Field of Classification Search
CPC ..... G09G 3/20; G09G 2300/0871; G09G 2310/027; G09G 2310/0291;
(Continued)

(56) References Cited

U.S. PATENT DOCUMENTS 5,739,803 A * 4/1998 Neugebauer ..... G09G 3/3625 345/100
6,020,869 A * 2/2000 Sasaki ..... G09G 3/3648 345/89
(Continued)

FOREIGN PATENT DOCUMENTS

CN 1122492 A 5/1996
CN 1448904 A 10/2003
(Continued)

OTHER PUBLICATIONS

Yuanfeng Fang, the ISA written comments, Jul. 2019, CN.
Yuanfeng Fang, The International Search Report, dated Jul. 2019, CN.

*Primary Examiner* — Andrew Sasinowski

(57) ABSTRACT

The present application discloses a driving method for a display panel, a driving device thereof and a display device. The driving method includes: performing square wave conversion on drive data to obtain data line signals, where square wave signals generated by the conversion of different gray scales in the corresponding drive data have an identical high level, and the time of high level output is different.

13 Claims, 10 Drawing Sheets

(58) Field of Classification Search
CPC ..... G09G 3/3688; G09G 2320/0233; G09G 2310/0289; G09G 2320/0223; G09G 3/3275; G09G 3/3685
See application file for complete search history.

(56) References Cited

U.S. PATENT DOCUMENTS

| | | | | |
|---|---|---|---|---|
| 6,404,135 | B1 * | 6/2002 | Shino | G09G 3/22 313/309 |
| 7,528,810 | B2 * | 5/2009 | Ohshima | G09G 3/3233 345/76 |
| 2001/0035862 | A1 | 11/2001 | Nakamura et al. | |
| 2003/0151599 | A1 * | 8/2003 | Bone | G09G 3/3648 345/204 |
| 2003/0218431 | A1 * | 11/2003 | Roh | G09G 3/288 315/169.1 |
| 2007/0001999 | A1 * | 1/2007 | Smith | G09G 3/3406 345/102 |
| 2017/0236471 | A1 | 8/2017 | Ota | |

FOREIGN PATENT DOCUMENTS

| | | | |
|---|---|---|---|
| CN | 101330792 | A | 12/2008 |
| CN | 101499248 | A | 8/2009 |
| CN | 102385837 | A | 3/2012 |
| CN | 103606362 | A | 2/2014 |
| CN | 106652963 | A | 5/2017 |

* cited by examiner

DRIVING METHOD FOR DISPLAY PANEL, DRIVING DEVICE THEREOF AND DISPLAY DEVICE

CROSS REFERENCE OF RELATED APPLICATIONS

The present application claims priority to Chinese Patent Application No. CN201811267637.1, filed with National Intellectual Property administration, PRC on Oct. 29, 2018, and entitled "DRIVING METHOD FOR DISPLAY PANEL, DRIVING DEVICE THEREOF AND DISPLAY DEVICE", which is incorporated herein by reference in its entirety.

TECHNICAL FIELD

The present application relates to the technical field of display, and in particular, to a driving method for a display panel, a driving device thereof and a display device.

BACKGROUND

The statements herein merely provide background information related to the present application and do not necessarily constitute the prior art.

With the development and advancement of technology, flat panel displays have become mainstream display products due to their thin bodies, power saving and low radiation, etc., and have been widely used. The flat panel displays include a thin film transistor-liquid crystal display (TFT-LCD), an organic light-emitting diode (OLED) display, and the like. The thin film transistor-liquid crystal display controls a rotation direction of liquid crystal molecules to refract light of a backlight module to produce a picture, and has many advantages such as thin body, power saving, and no radiation. The organic light-emitting diode display is made of organic light-emitting diodes, and has many advantages such as self-illumination, short response time, high definition and contrast, flexible display and large-area full-color display.

In a gray scale control mode of a display panel, digital-to-analog conversion occupies most of the area of a chip, and increases a manufacturing cost of the display panel.

SUMMARY

An objective of the present application is to provide a driving method for a display panel, a driving device thereof and a display device, which can save an area of a chip and save a manufacturing cost of the display panel.

To achieve the above objective, the present application provides a driving method for a display panel, which includes the steps of: receiving drive data corresponding to each channel; performing square wave conversion on the drive data to obtain data line signals; outputting the data line signal corresponding to each channel, and transmitting the data line signal to a corresponding data line on the display panel; and performing data driving on the display panel;

where in the step of performing square wave conversion on the drive data to obtain data line signals, square wave signals generated by the conversion of different gray scales in the corresponding drive data have an identical high level, and the time of high level output is different.

The present application also discloses a driving device for a display panel, which includes: a receiver that receives drive data corresponding to each channel; a square wave conversion chip that performs square wave conversion on the drive data to obtain data line signals; and an output device that outputs the data line signal corresponding to each channel, transmits the data line signal to a corresponding data line on the display panel, and performs data driving on the display panel;

where in the square wave conversion chip, square wave signals generated by the conversion of different gray scales in the corresponding drive data have an identical high level, and the time of high level output is different.

The present application also discloses a display device, which includes: a display panel and the above-mentioned driving device, where after receiving a set of data signals, the driving device outputs a set of data line signals by conversion, and transmits the set of data line signals to a set of corresponding data lines on the display panel; and the driving device controls a display state of the display panel and performs data driving on the display device.

In a solution, different levels are obtained by digital-to-analog conversion, i.e., high levels of generated signals are different, while the high levels continue for the same time, to achieve the purpose of data driving, and a digital-to-analog conversion circuit used in the digital-to-analog conversion method is complicated and occupies a large area of a chip. Compared with the solution, in the present application, not a digital-to-analog conversion method but a square wave conversion method is adopted, i.e., generated square wave signals have an identical high level, while the time of high level output is different. The high level in the square wave conversion method is constant and can be controlled by only a set of maximum voltage across reference voltages, which greatly lowers the design requirements for a peripheral circuit, saves the area of the chip, and saves a production cost of the display panel; there is no need to change the high level value, and only the high level output duration needs to be controlled, making operations easier, during the actual operation, the level may be first a low level and then a high level; first discharging is performed to implement a voltage lower than a required voltage, and then charging is performed to implement the required voltage through the high level.

BRIEF DESCRIPTION OF DRAWINGS

The accompanying drawings included are used to provide an understanding of the embodiments of the present application. The accompanying drawings form part of the specification, are used to illustrate the embodiments of the present application, and explain the principle of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
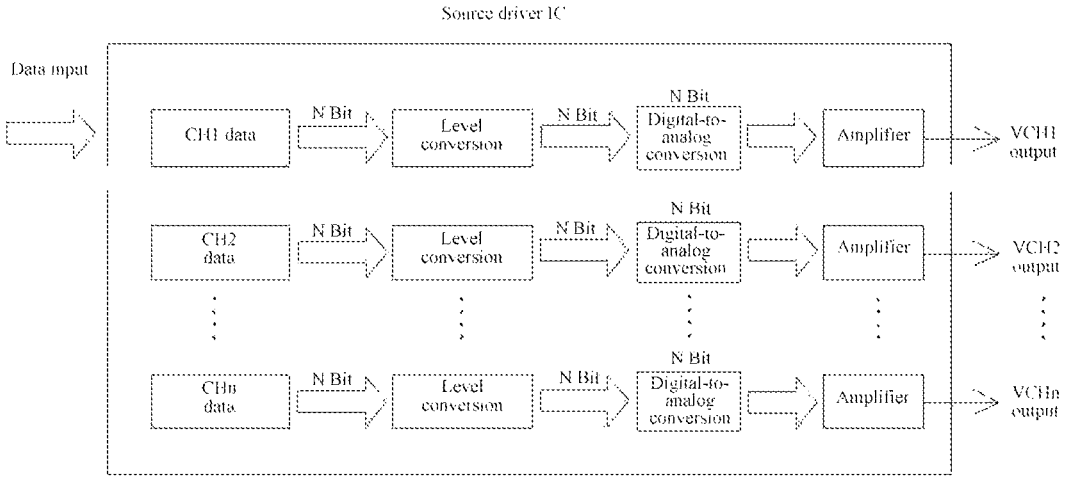
FIG. 1 is a schematic view of driving of a display panel according to an embodiment of the present application.

The specific structure and function details disclosed herein are merely representative, and are intended to describe exemplary embodiments of the present application. However, the present application can be specifically embodied in many alternative forms, and should not be interpreted to be limited to the embodiments described herein.

In the description of the present application, it should be understood that, orientation or position relationships indicated by the terms "center", "transversal", "upper", "lower", "left", "right", "vertical", "horizontal", "top", "bottom", "inner", "outer", etc. are based on the orientation or position relationships as shown in the drawings, for ease of the description of the present application and simplifying the description only, rather than indicating or implying that the indicated device or element must have a particular orientation or be constructed and operated in a particular orientation. Therefore, these terms should not be understood as a limitation to the present application. In addition, the terms "first", "second" are merely for a descriptive purpose, and cannot to be understood to indicate or imply a relative importance, or implicitly indicate the number of the indicated technical features. Hence, the features defined by "first" and "second" can explicitly or implicitly include one or more features. In the description of the present application, "a plurality of" means two or more, unless otherwise stated. In addition, the term "include" and any variations thereof are intended to cover a non-exclusive inclusion.

In the description of the present application, it should be understood that, unless otherwise specified and defined, the terms "install", "connected with", "connected to" should be comprehended in a broad sense. For example, these terms may be comprehended as being fixedly connected, detachably connected or integrally connected; mechanically connected or electrically connected; or directly connected or indirectly connected through an intermediate medium, or in an internal communication between two elements. The specific meanings about the foregoing terms in the present application may be understood by those skilled in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

A method known to the inventors is as follows: In a mode of controlling a liquid crystal display panel to display various gray scales, the display of the brightness is controlled mainly depending on the magnitude of a voltage, and the voltage corresponding to each data needs digital-to-analog conversion (DAC) processing inside a source driver. However, the DAC occupies the vast majority of an area design of a source driver IC of the source driver. As shown in FIG. 1, an internal architecture of an undisclosed source driver IC is provided. After data receival of each channel (CH1, CH2 . . . CHn), it is necessary to perform level shift→DAC→amplification by an operational amplifier (OP) to generate an output voltage of each channel (VCH1, VCH2 . . . VCHn), where the DAC is the part occupying the largest area, and an analog circuit for the DAC is designed; and the larger the N bits of the data, the larger the area.

Figure 2A:
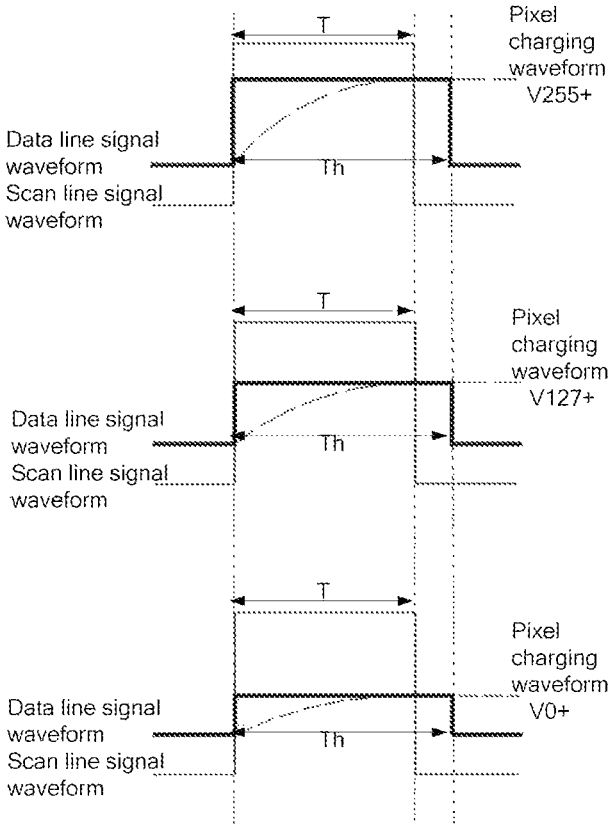
FIGS. 2*a-b* are schematic views showing pixel charging waveforms of a display panel according to an embodiment of the present application.
Figure 2B:
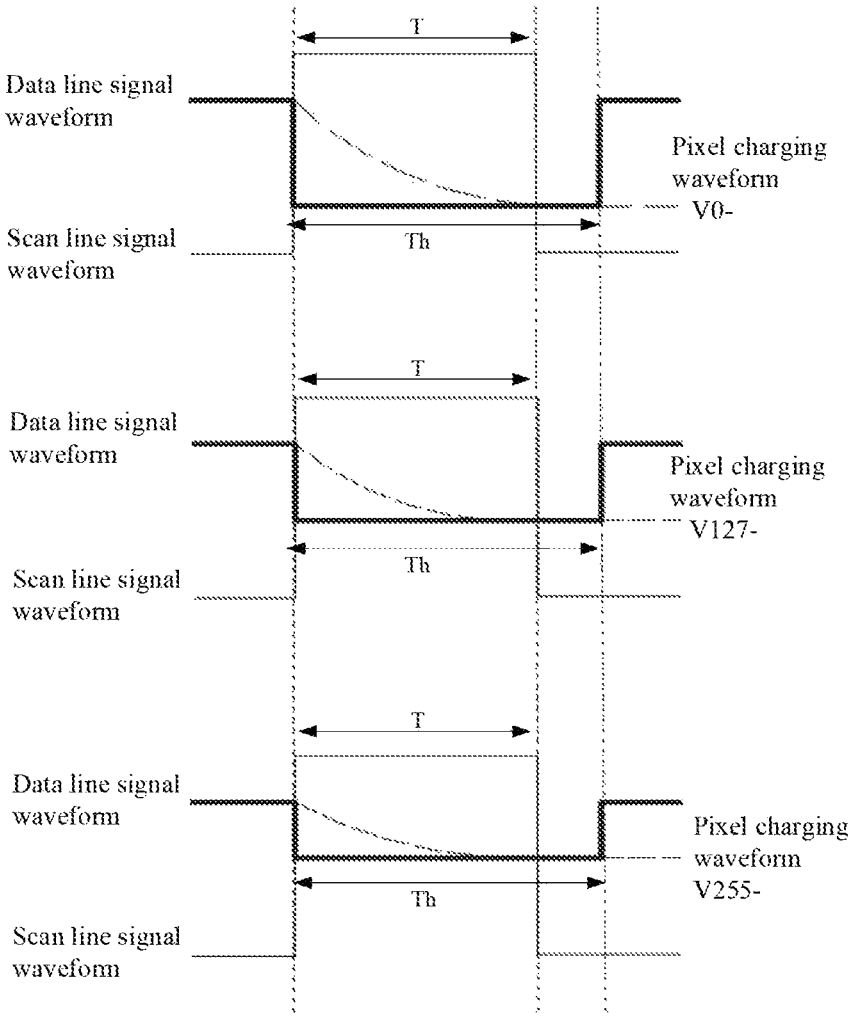

As shown in FIGS. 2*a-b*, taking an 8-bit display as an example, T is the charging time of each row of pixels, and Th is the total time of one row, and is determined by the output of a scan linegate. When the source chip outputs a voltage waveform corresponding to 0-255 gray scale, a charging waveform of a corresponding pixel is as shown in the figure, and during pixel charging, there will be a certain time for the change of the pixel voltage.

The present application will be described below with reference to the accompanying drawings and embodiments.

As shown in FIG. 3 to FIG. 7, an embodiment of the present application discloses a driving method for a display panel, including the steps: S71: Receive drive data corresponding to each channel. S72: Perform square wave conversion on the drive data to obtain data line signals. S73: Output the data line signal corresponding to each channel, and transmit the data line signal to a corresponding data line on the display panel; and perform data driving on the display panel, where in the step of performing square wave conversion on the drive data to obtain data line signals, square wave signals generated by the conversion of different gray scales in the corresponding drive data have an identical high level, and the high level output time is different.

In a solution, different levels are obtained by digital-to-analog conversion, i.e., high levels of generated signals are different, while the duration of high level is the same, to achieve the purpose of data driving, and a digital-to-analog conversion circuit used in the digital-to-analog conversion method is complicated and occupies a large area of a chip. Compared with the solution, in this solution, in the present application, not a digital-to-analog conversion method but a square wave conversion method is adopted, i.e., generated square wave signals have an identical high level, while the time of high level output is different. The high level in the square wave conversion method is constant and can be controlled by only a set of maximum voltage across reference voltages, which greatly lowers the design requirements for a peripheral circuit, saves the area of the chip, and saves a production cost of the display panel; there is no need to change the high level value, and only the high level duration needs to be controlled, making operations easier.

In an embodiment, in the step of performing square wave conversion on the drive data to obtain data line signals, after the time of the high level output of the square wave signals generated by the conversion of different gray scales is obtained by query from a preset square wave lookup table, the square wave conversion is performed on the drive data to obtain the data line signals.

TABLE 1

| Square wave lookup table | | | | |
|---|---|---|---|---|
| Gray scale voltage | Data (8 bits) | POL | Square wave width time | Reset time |
| V255+ | 11111111 | H | T255 | Δt |
| . . . | . . . | H | . . . | . . . |
| . . . | . . . | H | . . . | . . . |
| V1+ | 00000001 | H | T1 | Δt |
| V0+ | 00000000 | H | T0 | Δt |
| V0− | 00000000 | L | T0' | Δt |
| V1− | 00000001 | L | T1' | Δt |
| . . . | . . . | L | . . . | . . . |
| . . . | . . . | L | . . . | . . . |
| V255− | 11111111 | L | T255' | Δt |

In this solution, in order that the time of high level output of square wave signals generated by different gray scale values and conversion of different gray scales can be better converted to each other to ensure the driving stability of the display panel, the square wave lookup table is adopted; due to the difference in target gray scales, the different target gray scales are queried by using the square wave lookup table and output as different time of high level output; through the conversion by the square wave lookup table, the time of high level output capable of driving the target gray scales can be found, to achieve the better display effect, instead of a digital-to-analog conversion method, saving the area of a chip on the display panel; and at the same time, the high level in the adopted square wave conversion method is constant and can be controlled by only a set of maximum voltage across reference voltages, which greatly lowers the design requirements for a peripheral circuit, and saves a production cost of the display panel.

In an embodiment, the square wave lookup table stores a target gray scale voltage value and corresponding square wave width time as parameters; there is a time interval between the time of the high level output and the time of turning on a switch, and the time interval is square wave width time;

the step of querying from the preset square wave lookup table includes: querying and outputting corresponding square wave width time in the square wave lookup table according to the target gray scale voltage value, and after the time of high level output is calculated, performing square wave conversion on the drive date to obtain the data line signals.

In this solution, since the square wave lookup table is generated by full consideration of the gray scale value and high level information, the time corresponding to the high level output, which is output by using the square wave lookup table, meets the target requirement; it is ensured that during square wave conversion, the time corresponding to the high level output, which is output by using the square wave lookup table, conforms to the overall conception of the present application, and an optimal solution that conforms to a target gray scale voltage value is obtained by conversion; therefore, the adoption of this method improves the process of square wave conversion, replaces a data conversion method, saves the chip area, meets design requirements of a peripheral circuit, and saves a manufacturing cost of the display panel.

In an embodiment, the square wave lookup table stores a target gray scale voltage value, and corresponding square wave width time and reset time as parameters; there is a time interval between the time of the high level output and the time of turning on a switch, and the time interval is the sum of the square wave width time and the reset time;

the step of querying from the preset square wave lookup table includes: querying and outputting corresponding square wave width time and reset time from the square wave lookup table according to the target gray scale voltage values, where the reset time determines the start time of the high level output, and the square wave width time determines the duration of the high level; and after the time of high level output is calculated, performing square wave conversion on the drive data to obtain the data line signals.

In this solution, in order that the time of low level output of square wave signals generated by different gray scale values and conversion of different gray scales can be better converted to each other to ensure the driving stability of the display panel, the square wave lookup table is adopted; through the conversion of the square wave lookup table, the time of low level output capable of driving a target gray scale can be found, to achieve the better display effect, instead of a digital-to-analog conversion method, saving the area of a chip on the display panel; in the square wave lookup table, different low level output time corresponding to different gray scale values is queried and output through the query of the square wave width time and the reset time; because a previous frame inside a pixel has a residual voltage, the influence of the residual voltage inside the previous frame of the pixel can be avoided by resetting the square wave signal level to a highest level or a lowest level at the reset time, so that the correspondence of the square wave lookup table is more accurate; at the same time, because the high level in the square wave conversion method is constant and can be controlled by only a set of maximum voltage across reference voltages, which greatly lowers the design requirements for a peripheral circuit, and saves a production cost of the display panel. The square wave width time in stores delay time. When the delay time is recorded in the square wave lookup table, a square wave width time number can be expressed in a certain basic clock period T. In an embodiment, the step of performing square wave conversion on the drive data after the time of low level output of square wave signals is acquired, to obtain data line signals includes: performing logic operation: determining a gray scale voltage value by a polarity reversal setting signal (POL) to obtain a square wave waveform, inverting square waves to obtain an output logic waveform, and generating the data line signals according to the logic waveform.

In this solution, after the time of high level output of square wave signals is obtained, an output logic waveform is obtained through rigorous logic calculation; through logical calculation, it is ensured that the output logic waveform is accurate and correct, and data line signals conforming to a target gray scale are obtained, so that the solution has a better implementation effect.

In an embodiment, in the step of performing square wave conversion on the drive data to obtain data line signals, the logic waveform obtained after logic calculation is amplified through level conversion and an amplifier to obtain the data line signals. In this solution, when the potential of a high level of the square wave signals obtained by the logic calculation is small, the output drive data is insufficient to separately drive gray scale changes; and the output voltage is amplified by level conversion to achieve the goal of enabling the high level of the output square wave signals to smoothly drive the gray scale.

Figure 3:
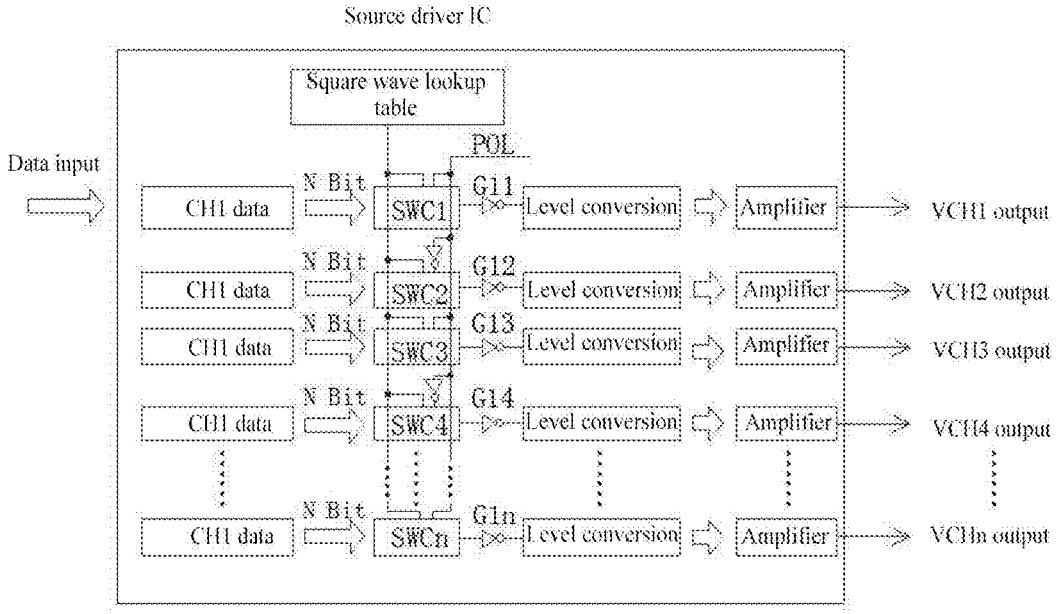
FIG. 3 is a schematic view of driving of another display panel according to an embodiment of the present application.
Figure 4A:
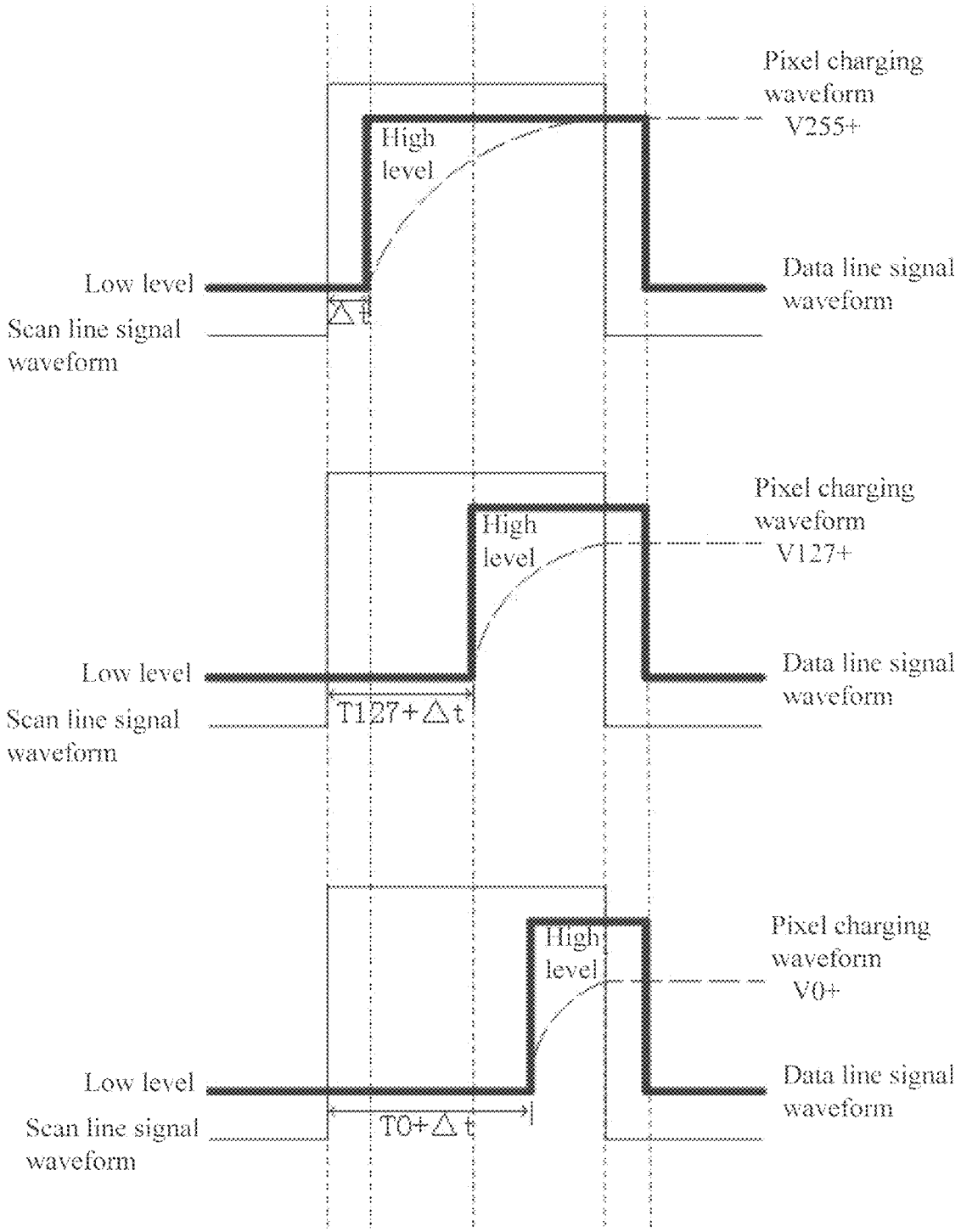
FIGS. 4*a-b* are schematic views showing pixel charging waveforms of another display panel according to an embodiment of the present application.
Figure 4B:
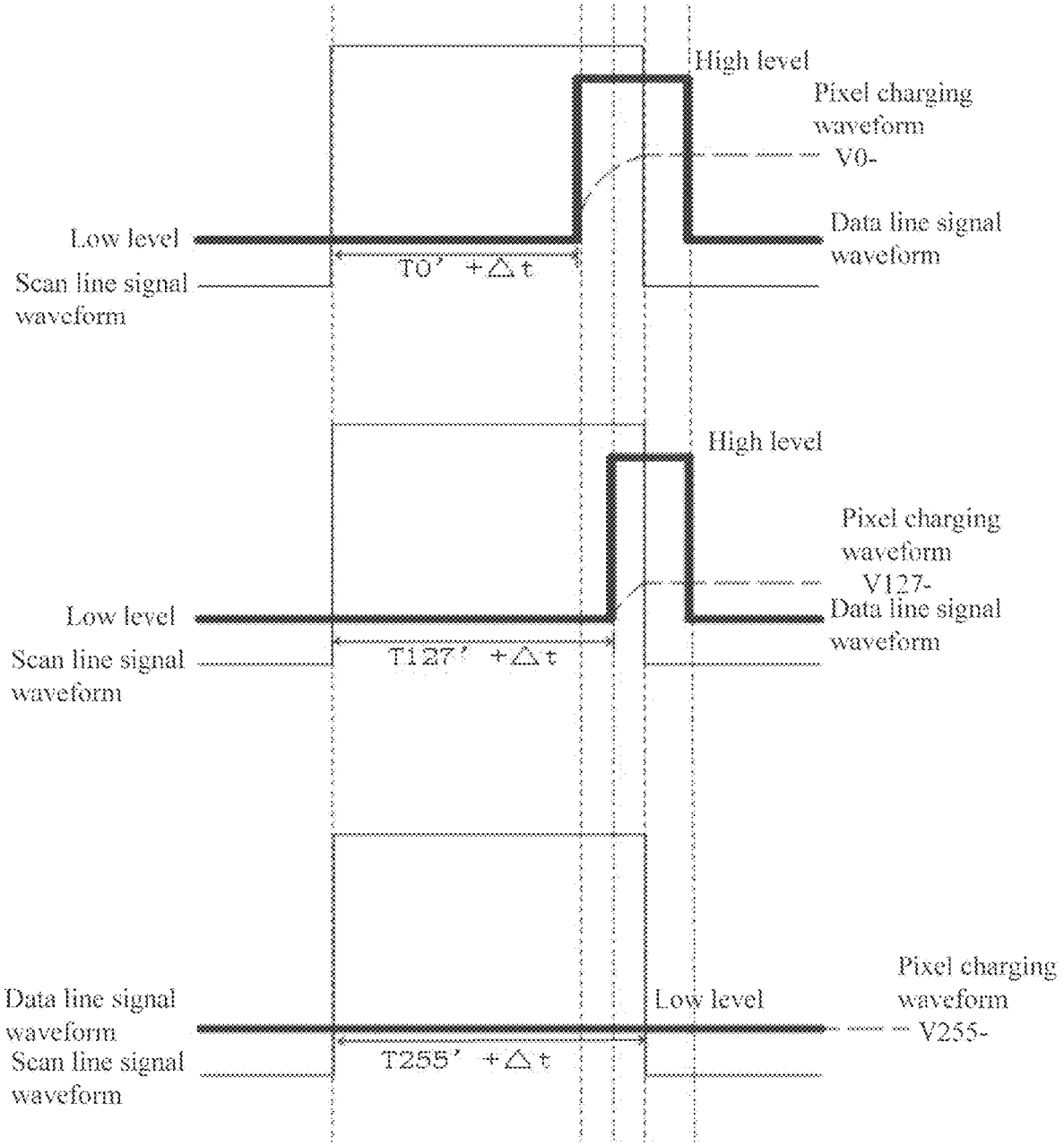
Figure 5:
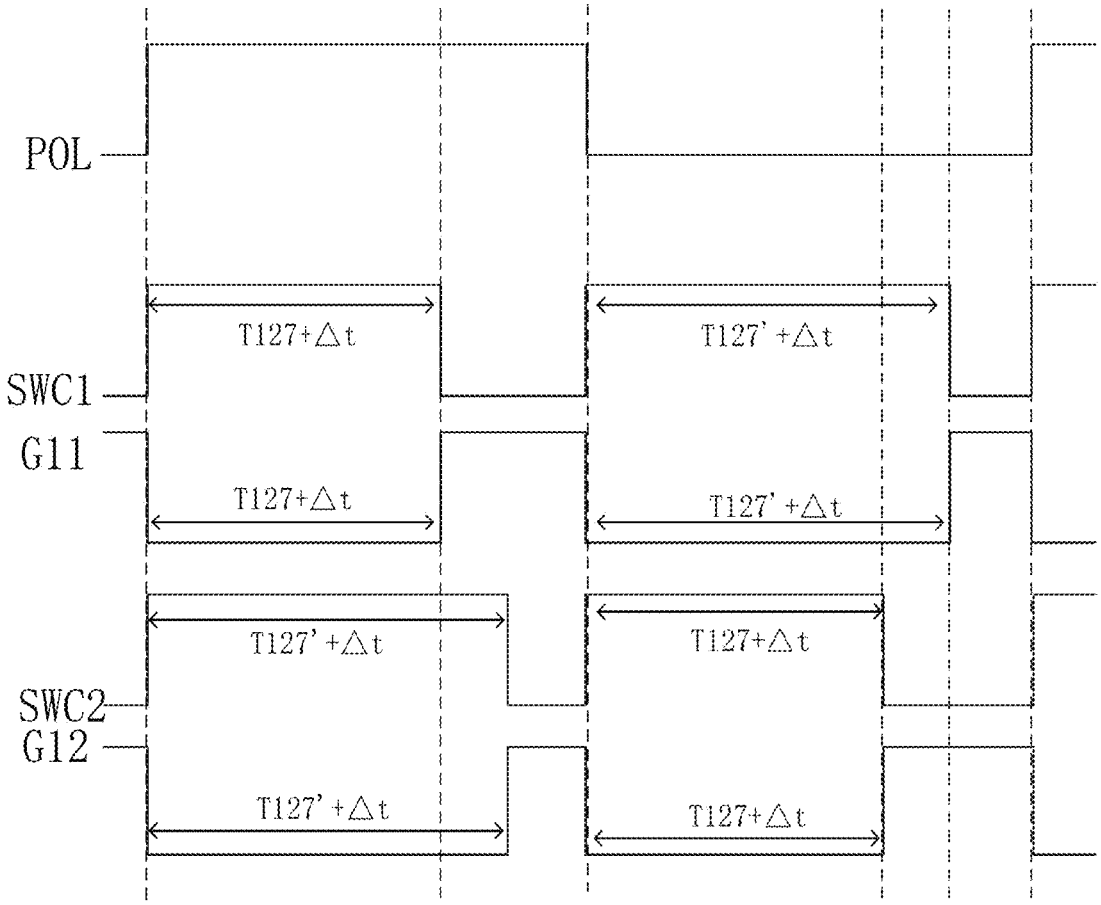
FIG. 5 is a schematic view of a square wave variation of a display panel according to an embodiment of the present application.
Figure 6:
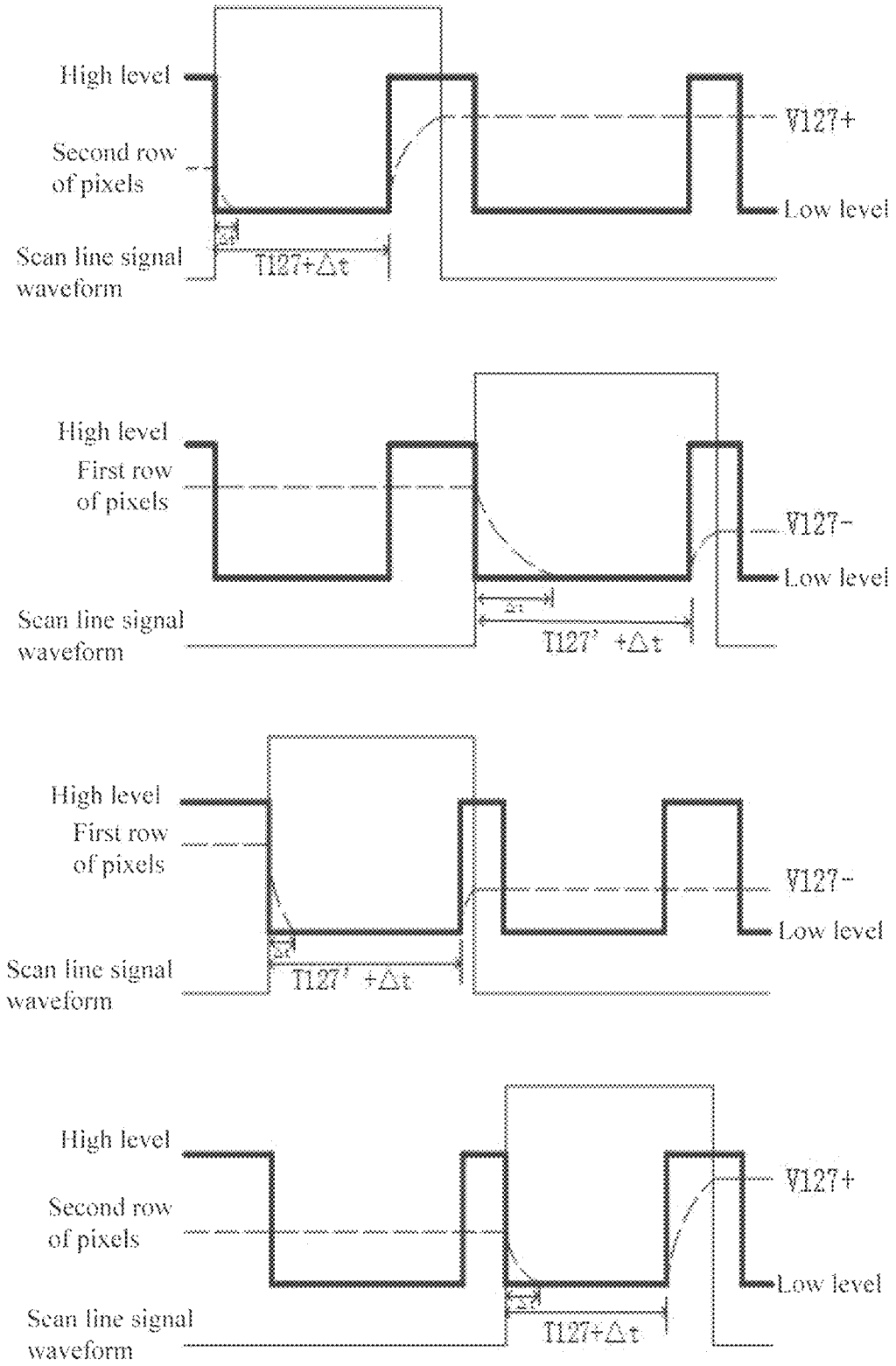
FIG. 6 is a view showing changes in pixel waveforms of a display panel according to an embodiment of the present application.

As shown in FIG. 3, if the waveform of a source is reduced by the time of T127, when the voltage climbs to the voltage of V127, a corresponding gate is just closed. At this time, a pixel voltage can be maintained at a voltage position of V127, and then the display of corresponding 127 gray scale is obtained. Similarly, when the waveform is reduced by the time of T0, a V0 voltage of a 0 gray scale can be obtained.

Figure 7:
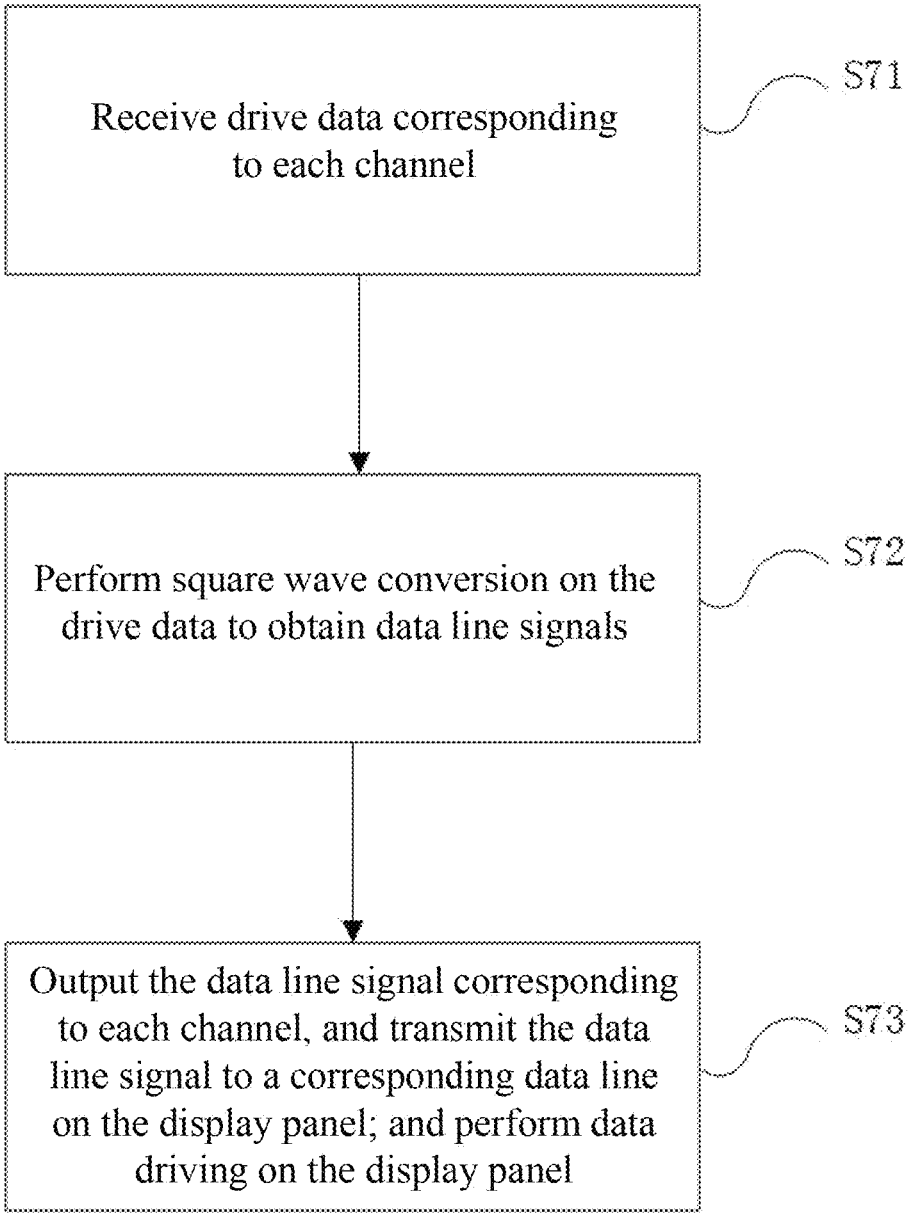
FIG. 7 is an application flow chart of a driving method for a display panel according to an embodiment of the present application.

As another embodiment of the present application, referring to FIG. 7, a driving device 100 for a display panel is disclosed, including: a receiver 200 that receives drive data corresponding to each channel;

a square wave conversion chip 300 that performs square wave conversion on the drive data to obtain data line signals; and an outputter 400 that outputs the data line signal corresponding to each channel, transmits the data line signal to a corresponding data line on the display panel, and performs data driving on the display panel, where in the step of performing square wave conversion on the drive data; where in the square wave conversion chip 300, square wave signals generated by the conversion of different gray scales in the corresponding drive data have an identical high level, and the time of high level output is different.

In a solution, different levels are obtained by digital-to-analog conversion, i.e., high levels of generated signals are different, while the high levels continue for the same time, to achieve the purpose of data driving, and a digital-to-analog conversion circuit used in the digital-to-analog conversion method is complicated and occupies a large area of a chip. Compared with the solution, in this solution, in the present application, after the drive data corresponding to each channel is received through the receiver 200, not a digital-to-analog conversion method but the square wave conversion chip 300 is adopted, so that generated square wave signals have an identical high level, while the time of high level output is different. The high level of the square wave conversion chip is constant and can be controlled by only a set of maximum voltage across reference voltages, which greatly lowers the design requirements for a peripheral circuit, saves the area of the chip, and saves a production cost of the display panel; there is no need to change the high level value, and only the high level duration needs to be controlled, making operations easier.

In an embodiment, the square wave conversion chip 300 includes a square wave lookup table, and the square wave lookup table stores a target gray scale voltage value, and corresponding square wave width time and reset time as parameters; there is a time interval between the time of the high level output and the time of turning on a switch, and the time interval is the sum of the square wave width time and the reset time;

corresponding square wave width time and reset time are queried and output from the square wave lookup table according to the target gray scale voltage values; the reset time determines the start time of the high level output, and the square wave width time determines the duration of the high level; and after the time of high level output is calculated, square wave conversion is performed on the drive data to obtain the data line signals.

In this solution, in order that the time of high level output of square wave signals generated by different gray scale values and conversion of different gray scales can be better converted to each other to ensure the driving stability of the display panel, the square wave lookup table is adopted; due to the difference in target gray scales, the different target gray scales are queried by using the square wave lookup table and output as different time of high level output; through the conversion by the square wave lookup table, the time of high level output capable of driving the target gray scales can be found, to achieve the better display effect, instead of a digital-to-analog conversion method, saving the area of a chip on the display panel; at the same time, the high level in the adopted square wave conversion method is constant and can be controlled by only a set of maximum voltage across reference voltages, which greatly lowers the design requirements for a peripheral circuit, and saves a production cost of the display panel. Since the square wave lookup table is generated by full consideration of the gray scale value and high level information, the time corresponding to the high level output, which is output by using the square wave lookup table, meets the target requirement; it is ensured that during square wave conversion, the time corresponding to the high level output, which is output by using the square wave lookup table, conforms to the overall conception of the present application, and an optimal solution that conforms to a target gray scale voltage value is obtained by conversion. Therefore, the adoption of this method improves the process of square wave conversion, replaces a data conversion method, saves the chip area, meets design requirements of a peripheral circuit, and saves a manufacturing cost of the display panel.

In an embodiment, the square wave conversion chip 300 includes a logic calculation chip, a level shifter, and an amplifier, where the logic calculation chip includes an inverter, the inverter inverts a waveform and then performs a calculation with a high level to obtain an output logic waveform; and the level shifter and the amplifier amplifies the logic waveform to obtain the data line signals.

In this solution, after the time of high level output of square wave signals is obtained, an output logic waveform is obtained through rigorous logic calculation; through logical calculation, it is ensured that the output logic waveform is accurate and correct, and data line signals conforming to a target gray scale are obtained, so that the solution has a better implementation effect. When the potential of a high level of the square wave signals obtained by the logic calculation is small, the output drive data is insufficient to separately drive gray scale changes; and the output voltage is amplified by level conversion to achieve the goal of enabling the high level of the output square wave signals to smoothly drive the gray scale.

Figure 8:
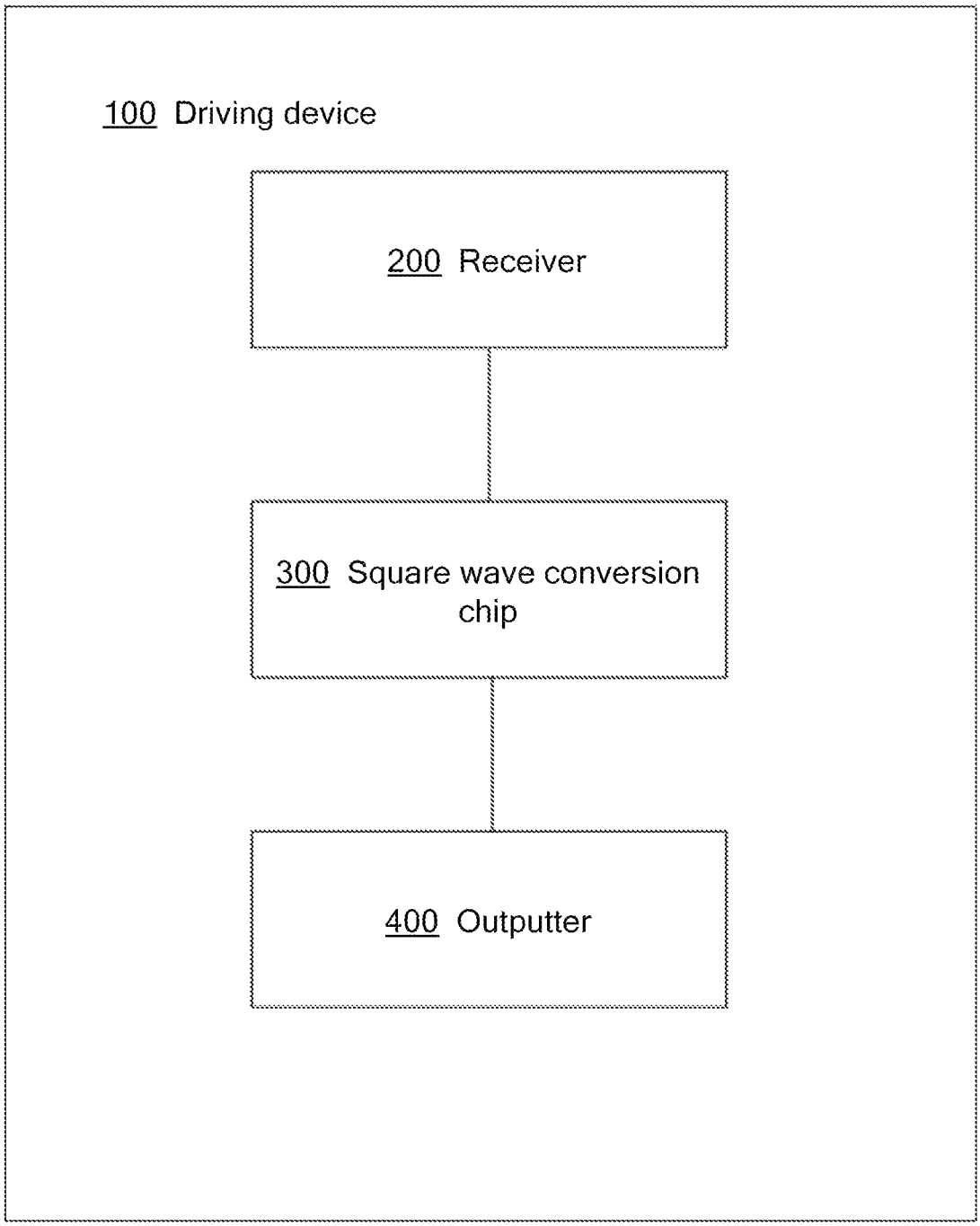
FIG. 8 is a schematic structural view of a driving device for a display panel according to an embodiment of the present application.
Figure 9:
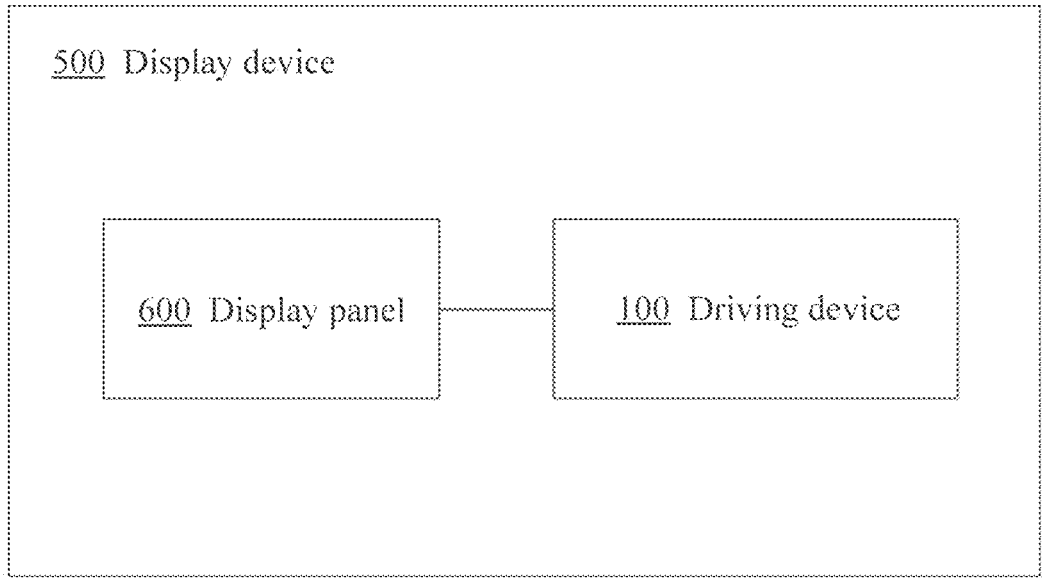
FIG. 9 is a schematic structural view of a display device according to an embodiment of the present application.

As another embodiment of the present application, referring to FIG. 8, a display device is disclosed, including: a display panel and the above-mentioned driving device, where after receiving a set of data signals, the driving device outputs a set of data line signals by conversion, and transmits the set of data line signals to a set of corresponding data lines on the display panel; and the driving device controls a display state of the display panel and performs data driving on the display device.

In this solution, the driving device 100 converts a received set of data signals, and outputs a set of data line signals to a set of corresponding data lines on a display screen by conversion, so as to achieve the goal that the driving device 100 can strictly control a display state of the display screen 600, and it is ensured that the display of the display screen 600 can be brought to a better state under the driving of the driving device 100.

In the figure, this solution uses a forward-driven 127 gray scale (T127) and a negatively-driven negative 127 gray scale (T127') after reversal, a forward-driven 0 gray scale (T0) and a negatively-driven negative 0 gray scale (T0') after reversal as examples to illustrate the specific implementation contents. However, the solution includes, but is not limited to, 0 gray scale and 127 gray scale in actual operation.

It should be noted that it is not determined that the limitation of each step involved in this solution limits the sequence of steps on the premise of affecting the implementation of the specific solution. The previous steps may be performed first, or may also be executed later, or even executed at the same time, which should be considered as being within the scope of protection of the present application as long as this solution can be implemented.

The technical solution of the present application can be widely applied to flat panel displays such as a thin film transistor-liquid crystal display (TFT-LCD) and an organic light-emitting diode (OLED) display.

The above are detailed descriptions of the present application in conjunction with the specific optional embodiments, but the specific implementation of the present application cannot be determined as being limited to these descriptions. For a person of ordinary skill in the art to which the present application pertains, a number of simple deductions or substitutions may also be made without departing from the concept of the present application. All these should be considered as falling within the scope of protection of the present application.

What is claimed is:

1. A driving method for a display panel, comprising the steps of:

receiving drive data corresponding to each channel;

performing square wave conversion on the drive data to obtain data line signals; and outputting the data line signal corresponding to each channel, and transmitting the data line signal to a corresponding data line on the display panel; and performing data driving on the display panel;

where in the step of performing square wave conversion on the drive data to obtain data line signals, square wave signals generated by the conversion of different gray scales in the corresponding drive data have an identical high level, and the time of high level output is different;

wherein in the step of performing square wave conversion on the drive data to obtain data line signals, after the time of the high level output of the square wave signals generated by the conversion of different gray scales is obtained by query from a preset square wave lookup table, the square wave conversion is performed on the drive data to obtain the data line signals;

wherein the square wave lookup table stores: a target gray scale voltage value and corresponding square wave width time as parameters; there is a time interval between the time of the high level output and the time of turning on a switch, and the time interval is square wave width time.

2. The driving method for a display panel according to claim 1, wherein the step of querying from the preset square wave lookup table comprises: querying and outputting corresponding square wave width tune in the square wave lookup table according to the target gray scale voltage value, and after the time of high level output is calculated, performing square wave conversion on the drive date to obtain the data line signals.

3. The driving method for a display panel according to claim 1, wherein the square wave lookup table stores: a target gray scale voltage value, and corresponding square wave width time and reset time as parameters; there is a time interval between the time of the high level output and the time of turning on a switch, and the time interval is the sum of the square wave width time and the reset time.

4. The driving method for a display panel according to claim 3, wherein the step of querying from the preset square wave lookup table comprises: querying and outputting corresponding square wave width time and reset time from the square wave lookup table according to the target gray scale voltage values, wherein the reset time determines the start time of the high level output, and the square wave width time determines the duration of the high level; and after the time of high level output is calculated, square wave conversion is performed on the drive data to obtain the data line signals.

5. The driving method for a display panel according to claim 4, wherein in the step of performing square wave conversion on the drive data to obtain data line signals, a logic waveform is obtained after logic calculation.

6. The driving method for a display panel according to claim 5, wherein the logic waveform obtained after the logic calculation is subjected to level conversion to obtain a converted square wave waveform.

7. The driving method for a display panel according to claim 6, wherein the square wave waveform obtained after the level conversion is amplified by an amplifier to obtain the data line signals.

8. The driving method for a display panel according to claim 1, wherein the step of performing square wave conversion on the drive data after the time of high level output of square wave signals is acquired, to obtain the data line signals comprises:

performing logic operation: determining a gray scale voltage value by a polarity reversal setting signal to obtain a square wave waveform, inverting square waves to obtain an output logic waveform, and generating the data line signals according to the logic waveform.

9. A driving device for a display panel, comprising:

a receiver that receives drive data corresponding to each channel;

a square wave conversion chip that performs square wave conversion on the drive data to obtain data line signals; and an outputter that outputs the data line signal corresponding to each channel, transmits the data line signal to a corresponding data line on the display panel, and performs data driving on the display panel;

where in the square wave conversion chip, square wave signals generated by the conversion of different gray scales in the corresponding drive data have an identical high level, and the time of high level output is different;

wherein the square wave conversion chip comprises a square wave lookup table, and the square wave lookup table stores: a target gray scale voltage value, and corresponding square wave width time and reset time as parameter; there is a time interval between the time of the high level output and the time of turning on a switch, and the time interval is the sum of the square wave width time and the reset time;

wherein corresponding square wave width time and reset time are queried and output from the square wave lookup table according to the target gray scale voltage values; the reset time determines the start time of the high level output, and the square wave width time determines the duration of the high level; and after the time of high level output is calculated, square wave conversion is performed on the drive data to obtain the data line signals.

10. The driving device for a display panel according to claim 9, wherein the square wave conversion chip comprises a logic calculation chip that comprises an inverter, and the inverter inverts a waveform and then performs a calculation with a high level to obtain an output logic waveform.

11. The driving device for a display panel according to claim 10, wherein the square wave conversion chip comprises a level shifter, and the level shifter converts a logic waveform to obtain a converted square wave waveform.

12. The driving device for a display panel according to claim 11, wherein the square wave conversion chip comprises an amplifier, and the amplifier amplifies the square wave waveform obtained by the level shifter to obtain the data line signals.

13. A display device, comprising: a display panel and a driving device, wherein the driving device comprises:

a receiver that receives drive data corresponding to each channel;

a square wave conversion chip that performs square wave conversion on the drive data to obtain data line signals; and an outputter that outputs the data line signal corresponding to each channel, transmits the data line signal to a corresponding data line on the display panel, and performs data driving on the display panel;

where in the square wave conversion chip, square wave signals generated by the conversion of different gray scales in the corresponding drive data have an identical high level, and the time of high level output is different;

after receiving a set of data signals, the driving device outputs a set of data line signals by conversion, and transmits the set of data line signals to a set of corresponding data lines on the display panel; and the driving device controls a display state of the display panel and performs data driving on the display device;

wherein the square wave conversion chip comprises a square wave lookup table, and the square wave lookup table stores: a target gray scale voltage value, and corresponding square wave width time and reset time as parameters; there is a time interval between the time of the high level output and the time of turning on a switch, and the time interval is the sum of the square wave width time and the reset time;

wherein corresponding square wave width time and reset time are queried and output from the square wave lookup table according to the target gray scale voltage values; the reset time determines the start time of the high level output, and the square wave width time determines the duration of the high level; and after the time of high level output is calculated, square wave conversion is performed on the drive data to obtain the data line signals.

* * * * *